US009546519B2

(12) United States Patent
Scopes

(10) Patent No.: US 9,546,519 B2
(45) Date of Patent: Jan. 17, 2017

(54) BORING RAM

(75) Inventor: Mark Edward Scopes, London (GB)

(73) Assignee: BRITISH TELECOMMUNICATIONS PUBLIC LIMITED COMPANY, London (GB)

( * ) Notice: Subject to any disclaimer, the term of this patent is extended or adjusted under 35 U.S.C. 154(b) by 695 days.

(21) Appl. No.: 13/978,275

(22) PCT Filed: Jan. 6, 2012

(86) PCT No.: PCT/GB2012/000010
§ 371 (c)(1),
(2), (4) Date: Jul. 3, 2013

(87) PCT Pub. No.: WO2012/095625
PCT Pub. Date: Jul. 19, 2012

(65) Prior Publication Data

US 2013/0270004 A1 Oct. 17, 2013

(30) Foreign Application Priority Data

Jan. 11, 2011 (EP) ..... 11250022

(51) Int. Cl.

| | |
|---|---|
| ***E21B 7/26*** | (2006.01) |
| ***E21B 7/04*** | (2006.01) |
| ***E21B 7/06*** | (2006.01) |
| ***E21B 47/022*** | (2012.01) |

(52) U.S. Cl.
CPC . *E21B 7/26* (2013.01); *E21B 7/04* (2013.01); *E21B 7/068* (2013.01); *E21B 47/022* (2013.01)

(58) Field of Classification Search
CPC ..... E21B 7/26
USPC ..... 175/19
See application file for complete search history.

(56) References Cited

U.S. PATENT DOCUMENTS

| | | | | |
|---|---|---|---|---|
| 4,726,711 | A * | 2/1988 | Tian | E21B 7/24 175/19 |
| 4,921,055 | A | 5/1990 | Kayes | |
| 5,022,634 | A * | 6/1991 | Keeble | G02B 6/4464 254/134.4 |
| 2004/0112638 | A1* | 6/2004 | Hofmann | E21B 4/14 175/19 |
| 2004/0226747 | A1 | 11/2004 | Stegmaier | |
| 2011/0024196 | A1* | 2/2011 | Allouche | E21B 7/046 175/73 |
| 2011/0272652 | A1 | 11/2011 | Scopes | |
| 2011/0274499 | A1 | 11/2011 | Scopes | |
| 2011/0274500 | A1 | 11/2011 | Scopes | |

FOREIGN PATENT DOCUMENTS

| | | |
|---|---|---|
| DE | 29 11 419 A1 | 11/1980 |
| EP | 0 301 287 | 2/1987 |
| GB | 2 111 565 | 7/1983 |
| GB | 2 386 142 | 9/2003 |
| WO | WO 89/06736 | 7/1989 |
| WO | WO 02/077406 A1 | 10/2002 |

* cited by examiner

*Primary Examiner* — George Gray
(74) *Attorney, Agent, or Firm* — Patterson Thuente Pedersen, P.A.

(57) ABSTRACT

A ram for boring through soil, including an elongate body terminating at one end in a head, wherein during use the head is separated from the body to form a channel therebetween for the soil to pass through from one side of the ram to another side of the ram.

12 Claims, 3 Drawing Sheets

BORING RAM

RELATED APPLICATIONS

The present application is a National Phase entry of PCT Application No. PCT/GB2012/000010 filed Jan. 6, 2012, which application claims the benefit of priority to EP Patent Application No. 11250022.8, filed Jan. 11, 2011, the entire disclosures of which are incorporated herein by reference.

TECHNICAL FIELD

The present invention relates to apparatus and methods relating to a boring device, particularly but not limited to the creation of underground service ducts for use with telephone lines, electric power and gas supplies, and the like.

BACKGROUND

Such horizontal bore holes can be created using powered boring rams (also known as moles). Generally, these comprise a tubular body including a reciprocal hammer enabling the ram to self-propel through the ground by compressing the soil surrounding the cavity or bore created. In preferred versions, the ram is capable of reversing its direction of operation, so that during use it can e.g. back away from an obstruction such as a tree root. Examples of such reversible rams are described in GB 2111565 and WO 89/06736.

The simpler boring rams can only move in a straight line direction (whether in forward or reverse mode), so that the only control an operative has over the flight or path taken, is its initial alignment into the ground. They are in this way limited in terms of maneuverability, as there is no or little scope for changing the flight of the ram where for example, the ram is diverted from its initial or intended path by the presence of an obstacle. This is a problem particularly in stony soil or where there is much buried debris, for which a common and very inefficient solution is to dig up the ram to re-align it.

One approach to this problem is described in EP 0301287 and GB 2386142 which describe rams capable of non-linear travel. These rams include an angled head (or tail) which allow the ram to be steered through an arc. In one version, the tubular body of the ram is rotated about its axis during use to achieve the turning effect in the desired direction. As may be expected, the radius of turn achieved is primarily dependent on the size of the body of the ram. Typically the radius of the arc is in the order of tens of meters. A significant distance may be unnecessarily traveled when this is not required, after alignment deflection. Also, such steerable arc rams produce considerable soil disturbance and displacement in use.

They are therefore not ideal for use where there is little room to manoeuvre. For example, shallow service ducts used for telecommunications optical fibre in the access network leading to customer premises are located a short distance below the surface of customers' front gardens or under residential street pavements. The creation of such shallow ducts requires care to ensure the ram stays underground and does not break through the ground surface. For example, the requirement of the National Joint Utilities Group of the UK is that telecommunications cables deployed within the footpath are placed with 250 to 350 mm ground coverage from the surface.

It would therefore be desirable to be able to alter the flight of a boring ram during use in a minimally-disruptive manner.

SUMMARY

According to a first aspect, there is provided a ram for boring through soil, comprising an elongate body terminating at one end in a head, wherein during use the head is separated from the body to form a channel therebetween for the soil to pass through from one side of the ram to be deposited on another side of the ram causing the ram to tilt away from the deposited soil.

A ram including a channel may be operated to obtain re-alignment where the ram has veered off its intended course, or else which might require some maneuvering to reach its desired destination which might not be in a completely straight line from the ram's point of launch. The ram works by passing soil through the channel at a point along the length of the ram. This causes the soil exiting the channel to be deposited in a layer which encourages the ram to move by tilting or pivoting in a direction away from the deposited soil layer.

In an embodiment, the channel can be opened and closed by way of a head which is separably attached to the body. In one embodiment, the head is moveably mounted onto the body, allowing the channel to be opened and closed. When it is open, soil enters the channel, is passed or pushed through, and exits the channel on the other side of the ram to form the layer of soil which then determines the direction of further movement of the ram.

In an embodiment, the channel is arranged to open when the ram is travelling in reverse mode, and is automatically closed by soil pushing on the head when travelling the forward direction. The combination of the effect of ploughing through the soil to pass soil from one long side of the ram to the other to lay down a soil layer, and then moving forward over and away from the soil layer causes the change in the path taken by the ram.

According to a second aspect, there is provided a head unit for use with a ram for boring through soil, comprising an attachment section for attachment at a first end to a ram, the attachment section terminating at another end in a head end, wherein during use the head end is separated from the attachment section to form a channel therebetween for the soil to pass through from one side of the head unit to another side of the head unit.

The head unit is a modular part suitable for fitting to the leading end of conventional rams of various types (hammer, manual, etc.), which would realize the advantages of the invention.

According to a third aspect, there is provided a method for boring through soil, comprising providing a ram according to the invention, or a ram including a head unit according to the invention, operating the ram through the soil in a forward mode to form a bore, operating the ram in a reverse mode in a direction opposite to the forward mode, obtaining passage of soil through the channel to pass through from one side of the ram to another side of the ram to deposit a layer of soil within the bore, and operating the ram in a forward mode towards the layer of soil, the presence of which causes the ram to tilt in a direction away from the layer of soil.

In one implementation of the method, the ram changes its forward path by reversing within the soil in a manner to cause the ram to tilt or pivot away from the soil deposit so that, when it again moves in the forward direction, the path taken by the ram has changed from that originally taken.

According to a further aspect, there is provided a system for boring through soil, comprising a ram according to the invention, or a ram including a head unit according to the invention, and apparatus for installing optical fiber.

BRIEF DESCRIPTION OF THE DRAWINGS

Embodiments of the invention will now be described, by way of example only, with reference to the accompanying drawings, in which.

DETAILED DESCRIPTION

Figure 1A:
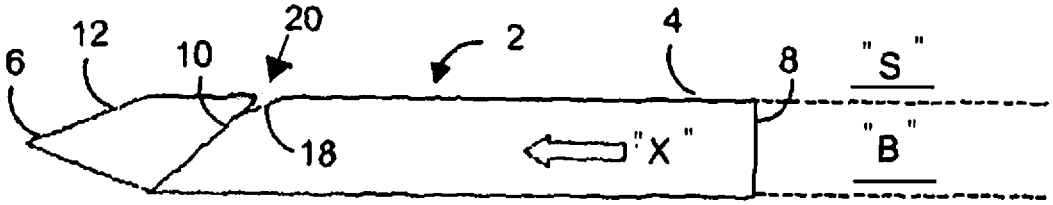
FIGS. 1A to 1C respectively depict the structure of a boring ram of an embodiment, and collectively depict the stages of operation of the boring device.
Figure 1B:
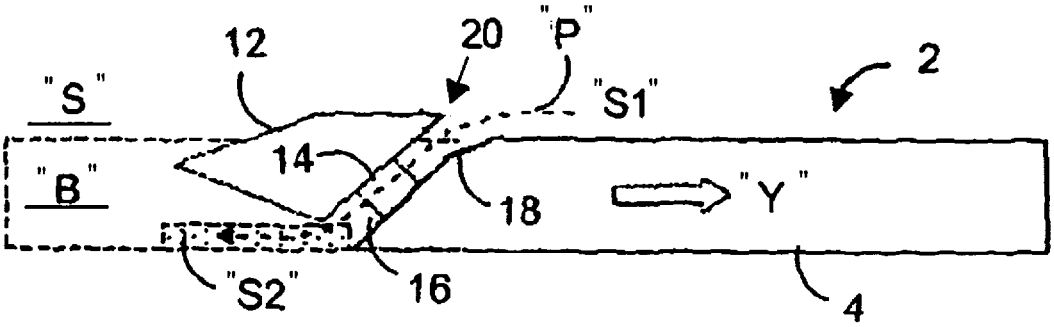
Figure 1C:
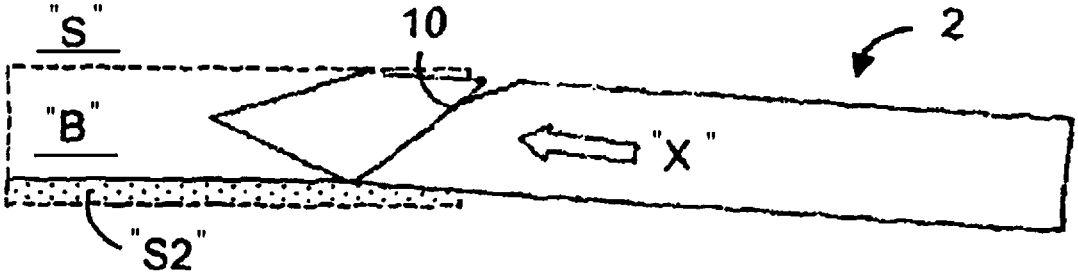

FIGS. 1A to 1C depict three views of a boring ram device (2), which each represents a stage of operation of the device during use. The boring device will be described here in the context of a powered ram, but as explained below, it may be used in other applications and implementations, including manually-driven rams. In the description, the invention may be referred to as a boring device, a boring ram, a borer or a reamer, or the like.

The boring device or ram in these figures is shown within the soil ("S") in an underground location, and comprises an elongate or tubular body (4), which terminates in a nose (6) at the head end (12) of the body. In the manner briefly discussed above in the documents mentioned, powered boring rams include within their bodies a reciprocating hammer allowing them to self-propel through the ground.

During use, the nose and the head end are the leading end of the boring ram which drives through the soil of the ground to create a bore ("B") which is depicted in FIG. 1A in the wake of the other, tail, end (8) of the boring ram which is travelling in the direction depicted by the arrow "X". In the case of a powered device, the ram hammers itself through the soil in the known fashion described in the documents referred to above.

During formation of the bore, the soil "S" within the ground is compacted around the streamlined body of the ram as the boring ram travels through the ground. The nose can have a profile of e.g. a chisel or other cutting point, to allow the ram to work through the ground so that the broken soil is compressed as it passes over it and along the sides of the elongate body. A rigid or pliable sleeve can be dragged after the ram so that the compacted soil is held back from collapse, allowing for the bore to be used e.g. as a service duct, or as a pipe or tube for installing optical fibre using the blown fibre method described in EP 108590. Alternatively, the ram can be used to pull into place cables, piping or the like for direct burial.

The boring ram includes a "split" line or seam (10) which is diagonal, or obliquely angled relative to the longitudinal axis of the body, as shown in the drawings of FIG. 1. In one embodiment, the ram comprises two parts, which are physically separable from each other along the seam (10). A connecting rod (14) holds the head end (12) to the rest of the ram body (4) in a manner which enables the head to move from a "closed" position (shown in FIGS. 1A and 1C) to an "open" position (shown in FIG. 1B).

Referring first to FIG. 1A, the ram is shown travelling in a forward direction (arrow "X"), during which the head is in a closed position so that it directly abuts against the body to form a contiguous tubular body terminating at the nose at the leading end and the tail at the opposite end.

In FIG. 1B, the ram has been put into reverse mode in accordance with known methods such as those described above, so that it is now travelling in the opposite direction (arrow "Y"). In this mode, a conventional reversible boring ram hammers itself backwards along the bore ("B") it previously created. It would typically not deviate from this path as the body would fit along the entire bore length, barring any soil collapse, new obstacles or the like.

During reverse mode operation of the ram of the present invention however, the head (12) of the ram separates from the body (4) of the ram so that a passageway or channel (16) appears between the two sections of the ram. As can be seen, the channel is not completely clear owing to the presence of the connector (14) within it. In the embodiment described here, the channel automatically opens up whenever the ram travels in reverse. This is due to the presence of a cutaway (18) at the corner of the body which would otherwise have abutted the lip (20) of the head when the ram is in a closed position. As shown in FIGS. 1A and 1C which depict the ram in its closed position, the cutaway portion resembles a chip or a nick on the otherwise contiguous surface of the ram. The slant of the seam (10) which separates head from body is angled so that the lip protrudes or juts over the cutaway portion in towards the tail of the ram.

This arrangement allows the head to stay in—indeed, be positively urged into—its closed position when the ram is travelling in a forward mode. In this mode, soil passes over the smoothly contiguous surfaces of the head and body, the protective lip serving to minimize the entry of soil into the cutaway and disruption of the progress of the ram. When the ram is in reverse mode however, soil ("S") is pushed into the cutaway. Continued backward movement of the ram in direction "Y" causes ever more of the surrounding soil to eventually push into the seam, and the resulting pressure of the soil causes the head to lift away and to separate from the rest of the body to form the channel (16) as shown in FIG. 1B.

The skilled person would appreciate that this is just one possible configuration, and that the capacity of the head to open and close may be obtained by its shape by means of a cutaway as described above, or for example by inclusion of a projection or catch extending rearwardly from the lip of the head, allowing for the ram to move forward with relatively little disruption, while enabling the head and body portions to be separated from each other when operating in the reverse mode.

When the leading end of the ram opens up in this manner, the lip (20) (and the rest of the head, in the embodiment shown in FIG. 1B) projects outwardly into the surrounding soil. As the opened ram is now wider than the bore it previously created, it no longer fits exactly within the bore and the surrounding soil ("S1") on the side of the ram where the lip is disposed is disturbed as the ram hammers backwards along the bore. The disturbed soil is scooped or ploughed into the channel as depicted by arrow "P", primarily by action of the cutaway and the lip during the ram's travel. The disturbed soil ("S1") from one side of the ram is pushed around the connector (14) and through the channel by further soil entering the channel as the ram continues travelling backwards. The disturbed soil eventually passes through the ram and is deposited on the other side of the ram as deposited soil ("S2").

The effect of ploughing through the soil and passing it from one side of the ram to the other side (i.e. from the "S1" to "S2" locations, which are respectively on the long sides of the ram diametrically opposite to each other) is to change the direction of the ram's path during travel. As can be seen from FIG. 1B and also in FIG. 1C, the deposited soil "S2" is laid down in a layer on the bottom of the bore "B" previously formed.

When the ram is once again put into a forward mode of operation (as shown by arrow "X" in FIG. 1C), the ram head closes up. When the direction of travel changes, the soil scooping action stops, so soil stops entering the channel. At the same time, the soil surrounding the cutaway (18) and the lip (20) bears upon them, causing the head to start closing. As will be described below against FIG. 2, the surfaces making up the channel can be configured, as described further below, to "squeeze" out any soil still within it when the head starts closing. Eventually the channel is completely or substantially completely closed, with the soil previously within it having passed through to form a layer of deposited soil "S2" within the bore. As the ram moves forward, the presence of the deposited soil causes the ram to tilt and to head in a direction away from the soil layer, as shown in FIG. 1C. In other words, putting the ram into the forward mode after reversing it causes the nose (6, in FIG. 2) of elongate ram to tilt away from the accumulation of deposited soil in a pivoting motion. This causes the ram to diverge from the forwards path originally taken prior to being put into the reverse mode. Driving the ram forwards and backwards a number of times will have an effect of pivoting the ram in a direction orthogonal to the long axis of the ram, in a manner similar to a car performing a "three-point turn" on a road.

Assuming the application shown in the drawings of FIG. 1 were deemed to be side views, FIG. 1C shows how the body of the ram veers away from the deposited soil so that it tilts upwards due to the body being urged in that direction during forward travel, owing to the presence of the deposited soil at the base of the bore. The exact direction of re-alignment is dependent on the orientation of the channel, which in this example slants from upper right to lower left, where the ram travels right in reverse mode. Here, the soil located on the upper right-hand side or surface of the ram body is disturbed and gets pushed through the channel to be deposited on the lower left-hand side of the ram.

As may be expected, if the channel were oriented in the opposite direction (i.e. from lower right to upper left), the effect during use would be that the ram would turn or tilt downwards. Of course, the ram, and consequently the channel, can be oriented in any direction through 360 degrees, and the drawings of FIG. 1 can be interpreted to depict a view of the operation of the ram in any such possible orientations, so that if they were deemed to be plan views, the channel runs parallel to the ground surface and the ram during operation would be caused to tilt to the right in the forward direction following passage of soil from the right side or surface to the left side of the ram.

The above process thus resets the direction taken the ram, which will continue to travel in the new direction as set by the orientation unless and until it is further defected by hitting obstacles, encountering changes within the soil type or compaction, or if the operative chooses to re-align the ram again using above technique.

In general, the direction of the soil passage through the channel (arrow "P") is configured to encourage soil to enter and exit, so the channel is provided at an angle oblique to the elongate body's longitudinal axis, wherein the soil travel direction at the entrance and exit sections describe obtuse angles relative to the longitudinal axis. While it is possible to provide the channel in a direction orthogonal to the body's long axis, a gentler channel slope can be implemented to encourage soil passage.

The boring ram can be used to achieve greater turning effect if it is deployed a number of times alternating between the forwards and reverse modes in succession. With each iteration, a certain degree of turning or tilting is obtained, akin to a car going through a "three-point" turn. The cumulative effect of this "shuffling" action is that greater or steep angles of turning or tilting can be obtained whenever required. This capability enables the ram of the invention to change its path within a distance much shorter than is possible with the conventional arc-type moles described above. By passing soil from side to side through the body in the manner described above, re-alignment of the flight or path of the ram can be obtained within the order of meters of the bore for a ram of about 550 mm in length. Correspondingly the amount of spoil produced is considerably reduced, which is a significant advantage in shallow boring applications.

In an embodiment using a ram which is capable of being rotated during use, the channel can be selectively oriented, allowing for the ram the steered and re-aligned along its path by turning the ram in any desired direction using the method described above.

Figure 2:
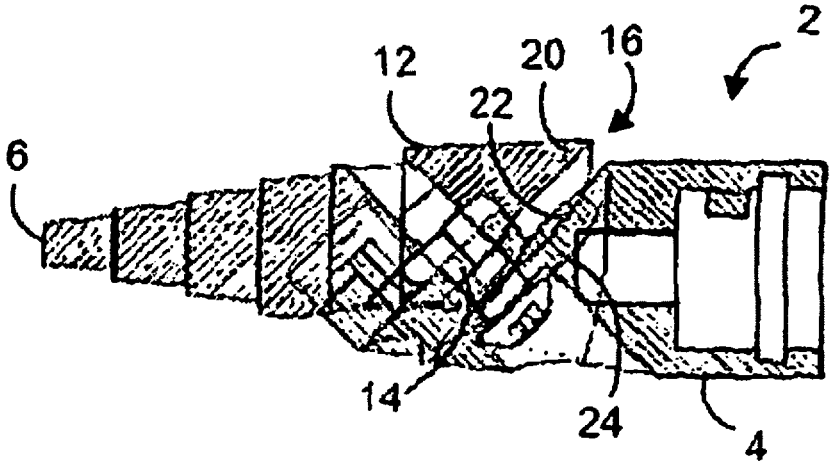
FIG. 2 depicts details of the head section of the boring ram.

FIG. 2 is a cross-sectional view of the leading end of the ram (2). The head (12) terminates in a nose portion (6), which during use is the leading end being hammered through the ground, and so comprises a stepped chisel for its cutting properties. The head is slideably mounted on the main part of the body (4) by a connector (14) which in the embodiment shown is a round head allen bolt, allowing for the two parts to move towards and away from each other. When the head and main body sections are separated while the channel of the ram is in an "open" position, the head surface (22) and the body surface (24) face each other across the channel (16). The respective facing surfaces making up the channel are in the main substantially parallel to each other, and the distance between them is determined by the length of the connecting shaft (14).

In an embodiment, the facing surfaces further each have a substantially curved profile. The surfaces, together with the cutaway (18), serve to "squeeze" soil out of the channel when the head portion starts to close as the ram travels forwards. Soil within the channel is encouraged out by removal from the entrance or inlet end towards the exit or outlet end for deposit as layer (S2).

The connector (14) can take any form allowing for the sections to move away from and towards each other to form the channel between them. The skilled person would be able to conceive of other attachment methods, such as by use of a single or double hinge so that the sections pivot to and from each other, using a screw to allow the section to rotate towards and away from each other, and so on. The attachment means need not be positioned in the middle of the section faces: they could be located on the edge or circumference of the section faces, in applications where e.g. the central position of the connecting bolt or rod gets in the way of soil passage through the channel.

For convenience, the description refers to the head as the part of the ram which is separable from the rest of the body to form the channel allowing for soil passage from one long side of the ram to the other long side. However, it would be appreciated that the "head" could also be considered to be the entire device shown in FIG. 2, including the "body" section (4) as well as the channel therebetween. In one application, such a head section or unit may be a modular part suitable to fitting to conventional boring rams to impart the advantages realisable with the invention. In such an implementation, the "head" and "head section" referred to herein shall be taken to refer to the separated and/or separable part of this end of the ram and referred to as "head unit", and the "body" be construed to refer to the section of the modular unit to be connected to the rest of the ram.

In use, the progress of the boring ram within the ground can be monitored with a sonic location beacon or a digital compass located within a vibration-isolated tail section of the ram—this provides flight direction and orientation.

Figure 3:
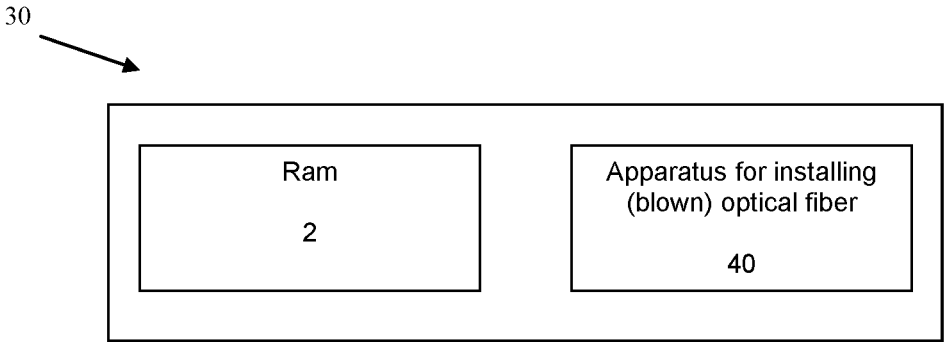
FIG. 3 depicts a system for boring through soil.

FIG. 3 depicts a system 30 for boring through soil. The system 30 comprises a ram 2 and an apparatus 40 for installing optical fiber. In one embodiment, the apparatus 40 for installing optical fiber comprises an apparatus 40 for installing blown optical fiber.

The methods, devices and configurations described above and in the drawings are for ease of description only and not meant to restrict the invention to any particular embodiments. It will be apparent to the skilled person that various components, devices and permutations on the methods and devices described are possible within the scope of this invention as disclosed. Similarly the invention could be deployed in a variety of contexts to realise the advantages afforded by its use. The skilled person would also appreciate that a number of variations may be made to the precise location and configuration and materials used for the components and parts making up the apparatus, that would be within the scope of the inventive concept.

For example, the channel can be opened up by use of powered remote control by the operative. This could be effected while the ram is operating in the forward and reverse modes. The re-aligning effect of using the invention may be obtained using a manually-driven ram. Greater turning over a smaller distance can be obtained by using a ram which is reversible, but it would be appreciated that even in a single-direction application, causing the channel to open (e.g. by remote control) could allow a measure of re-alignment. A ram with a permanently-open channel could serve to form arc'd bores. The scooping effect of the cutaway and/or the lip can be achieved by causing one or both of these components to protrude without moving the entire head: this effect could be obtained by e.g. pivoting the head instead of sliding it. The channel may be provided with controllable variation on its width between the two facing surfaces to cope with different soil types and terrains, or to allow specific pieces of debris within the channel to pass though to prevent choking. The soil channel can be placed at other positions along the length of the ram body. In a larger/wider ram, the channel could direct soil to a side of the ram which is not diametrically opposite to the intake side, which determines on which side the soil passing through is deposited. In yet other implementations, the channel could comprise a bore which passes soil along at least part of the length of the body before it is passed out. A full channel is also not necessary and side cut outs may serve the purpose as well, at least to some extent.

It would also be appreciated that the ram may be used in a variety of applications in which a device is to be driven or bored through a soil made up of elements which are capable of being passed from one side of the ram to the other, which reference includes soil-like materials such as flour or the like.

The invention claimed is:

1. A ram for boring through soil, comprising: an elongate body terminating at one end in a head, wherein the head is separably attached to the body, and wherein the ram is configured to move between an open channel position in which the head is separated from the body to form a channel therebetween, and a closed channel position in which the channel is closed by the abutment of the head against the body, and wherein the ram is arranged in use to be operable in a forward mode, in which the ram is caused to travel in a direction led by the head, and in a reverse mode, in which the ram is caused to travel in a direction opposite to the forward direction, and wherein the ram is configurable into a closed channel position when the ram operates in the forward mode, and into an open channel position when the ram operates in the reverse mode whereby soil is passed through the channel from one side of the ram to be deposited on another side of the ram such that putting the ram into forward mode after reversing the ram causes the ram to tilt away from the deposited soil.

2. A ram according to claim 1, wherein during use, the head is moved between the open channel position and the closed channel position by action of soil against a protrusion from the head.

3. A ram according to claim 1, wherein the head is slideably attached to the body.

4. A ram according to claim 1, wherein the elongate body has a longitudinal axis, and wherein the channel is disposed at an angle oblique to the longitudinal axis, and wherein in use the soil passes through the channel by entering and exiting the channel at obtuse angles relative to the longitudinal axis.

5. A ram according to claim 1, wherein the ram is self-propelling.

6. A ram according to claim 1, wherein the ram is capable of being rotated during use.

7. A system for boring through soil, comprising:

a ram according to claim 1; and an apparatus for installing optical fiber.

8. A system according to claim 7, wherein the apparatus for installing optical fiber comprises apparatus for installing blown optical fiber.

9. A head unit for use with an elongate ram body to form a ram according to claim 1 for boring through soil, the head unit comprising:

an attachment section and a head end, the attachment section being operable to attach at one end to the elongate ram body, the attachment section terminating at another end in the head end, wherein during use the head end is separable from the elongate ram body to form a channel therebetween for soil to pass through from one side of the head unit to another side of the head unit.

10. A method for boring through soil, comprising:

providing a ram according to claim 1;

operating the ram through the soil in a forward mode to form a bore;

operating the ram in a reverse mode in a direction opposite to the forward mode to cause passage of soil through the channel from one side of the ram to another side of the ram to deposit a layer of soil within the bore; and subsequently operating the ram once more in a forward mode towards the layer of soil, the presence of which causes the ram to tilt in a direction away from the layer of soil.

11. A method according to claim 10, further comprising changing the operation of the ram between the forward mode and the reverse mode four or more times in succession.

12. A method according to claim 10, wherein operation of the ram in the forward mode comprises operation in a direction along a first path, and subsequent operation of the ram in the forward mode after operation in the reverse mode causes the ram to operate in a direction along a second path divergent from the first path.

* * * * *